US005384968A

United States Patent [19]

Grandjean

[11] Patent Number: 5,384,968

[45] Date of Patent: Jan. 31, 1995

[54] PAPER REMOISTENING APPARATUS

[75] Inventor: Alain J. Grandjean, Evry, France

[73] Assignee: Materiels Equipments Graphics, S.A., Lisses-Evry, France

[21] Appl. No.: 58,538

[22] Filed: May 5, 1993

[30] Foreign Application Priority Data

May 6, 1992 [FR] France ..... 92 05566

[51] Int. Cl.[6] ..... F26B 21/06

[52] U.S. Cl. ..... 34/79; 34/635

[58] Field of Search ..... 34/15, 27, 32, 92, 60, 34/635, 79; 162/204, 207, 205

[56] References Cited

U.S. PATENT DOCUMENTS 3,198,199 8/1965 Schultz ..... 134/122

FOREIGN PATENT DOCUMENTS 417609 4/1968 Australia .
1218613 5/1960 France .
2393616 1/1979 France .
1082277 5/1960 Germany .
1101447 3/1961 Germany .

*Primary Examiner*—Henry A. Bennet
*Attorney, Agent, or Firm*—Mitchell D. Bittman

[57] ABSTRACT

The present invention relates to a paper remoistening apparatus of the type which drives a strip of paper along a predetermined path within a sealed enclosure, into which nozzles for spraying a moistening mist open and which communicates at a place remote from the spray nozzles with the inlet of a suction device having its outlet opening outside the enclosure.

10 Claims, 3 Drawing Sheets

FIG. 3
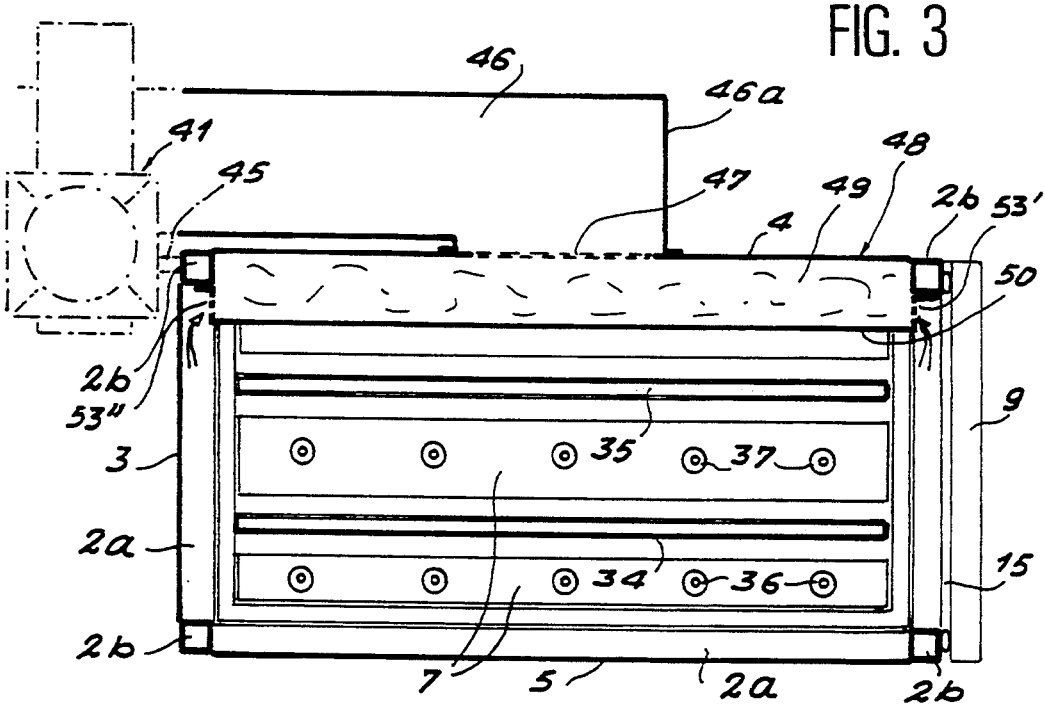
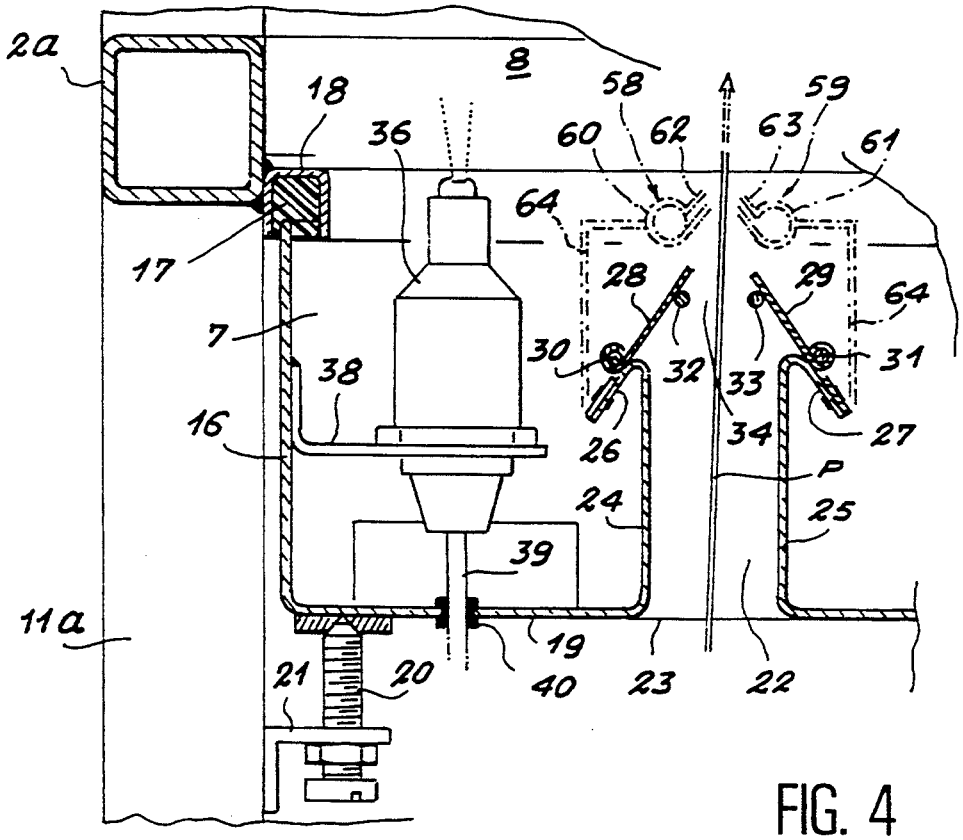
FIG. 4

PAPER REMOISTENING APPARATUS

The present invention relates to a paper remoistening apparatus of the type comprising means for driving a strip of paper along a predetermined path within a sealed enclosure, into which nozzles for spraying a moistening mist open and which communicates at a place remote from the spray nozzles with the inlet of a suction device having its outlet opening outside the enclosure.

Such remoistening apparatus are used in printing lines for newspapers, books or other publications printed on paper support. A remoistening apparatus of this type is positioned downstream of a drier from which a continuous web of printed paper exits with a slight undulation due to the non-uniform drying, and acts to restore its initial smooth aspect to the web by impregnating the same over the entire surface thereof with finely sprayed water in the form of a mist in pressurized air.

There is known a remoistening apparatus of this type which is disclosed in application AU-B-417 609 (FMC CORPORATION), but which does not make it possible to remove the drops of water in excess in the enclosure with the required efficiency.

Indeed, the use of such remoistening apparatus is found to suffer from a major drawback, which is due to the fact that the mist built up within the enclosure and its contact with the walls thereof causes the formation of drops of water, which, when falling on the running web of printed paper, may create such spots on it as to make the printed publications produced unsuitable for sale.

The object ot the present invention is to remedy said drawback and, to this effect, the invention is directed to a remoistening apparatus of the type specified in the introduction, characterized in that the inlet of the suction device communicates with the enclosure through a droplet separator, which will intercept the water droplets suspended in the mist before expelling said mist out of the remoistening apparatus. With this apparatus, the moistening mist can thus be made homogeneous around the paper; also, as the air exiting from the suction device is freed from its excess water, it may be advantageously recycled to moisten the stocks of paper awaiting printing, with no discomfort for the employees since a rise in the degree of moisture of the closed environment of the remoistening apparatus is avoided, which could be highly inconvenient for the service personnel.

When adequately positioned with respect to the nozzles and paper path, the suction device associated with the droplet separator will circulate the sprayed mist within the enclosure and remove it rapidly from the latter after fulfillment of its paper remoistening function. This results in decreasing significantly the holding time of the mist within the enclosure and minimizing the contact thereof with the walls of the latter, to noticeably reduce, or even totally eliminate, the formation of water drops responsible for the defects found in current remoistening apparatus.

Advantageously, the suction device is a fan.

In a preferred embodiment of simple design, the droplet separator comprises a duct fitted internally and over its entire cross-section with a three-dimensional mesh of entangled metal fibres, said duct being, on one side, connected to the inlet of the suction device and opening, on the other side, into the bottom portion of the enclosure, away from the paper web path and above a tank, which collects the water dripping off the droplet separator.

In addition, the duct also opens laterally into a region located between the inlet of the suction device and the bottom portion of the enclosure.

According to another feature of the invention, the enclosure is limited in its bottom portion by a floor provided with two generally parallel narrow slots for the strip of paper to come in and out, respectively, and the spray nozzles are disposed in two rows extending on each side of one same slot, with the inlet of the suction device communicating with the bottom portion of the enclosure on the side of the second slot opposite to the first slot.

Preferably, the two rows of nozzles extend on each side of the paper strip inlet slot, and the opening, through which said inlet of the suction device communicates with the enclosure extends in the same direction and at least over the same length as the rows of nozzles.

All these features provide a uniform remoistening of the web of paper over its full width as well as along the full length of its running path within the sealed enclosure.

Advantageously, the enclosure has a vault-shaped roof connecting without any dead space to the adjacent walls of the enclosure.

The risks of water drops collecting on the inner walls and the roof of the enclosure swept by the circulating mist are thus minimized.

Besides, the drops of water that would yet form in contact with the walls and roof of the enclosure, could drip down therealong to spare the web of paper and could be collected in the bottom portion of the enclosure by a pan preferably forming the floor of said enclosure.

According to an additional feature of the invention, each of the paper web inlet and outlet slots of the enclosure is bordered on both sides thereof with two respective dry air blowing ramps, which by forming air waves that sweep the web of paper running through each of said slots ensure perfect sealing along the latter in all cases.

A remoistening apparatus according to a preferred embodiment of the present invention will now be described in more details, by way of a non-limiting exemple only, with reference to the accompanying drawings, wherein:

FIG. 3 is a sectional view taken along line III—III of FIG. 1; and

FIG. 4 is an enlarged representation of a detail of FIG. 2.

Figure 1:
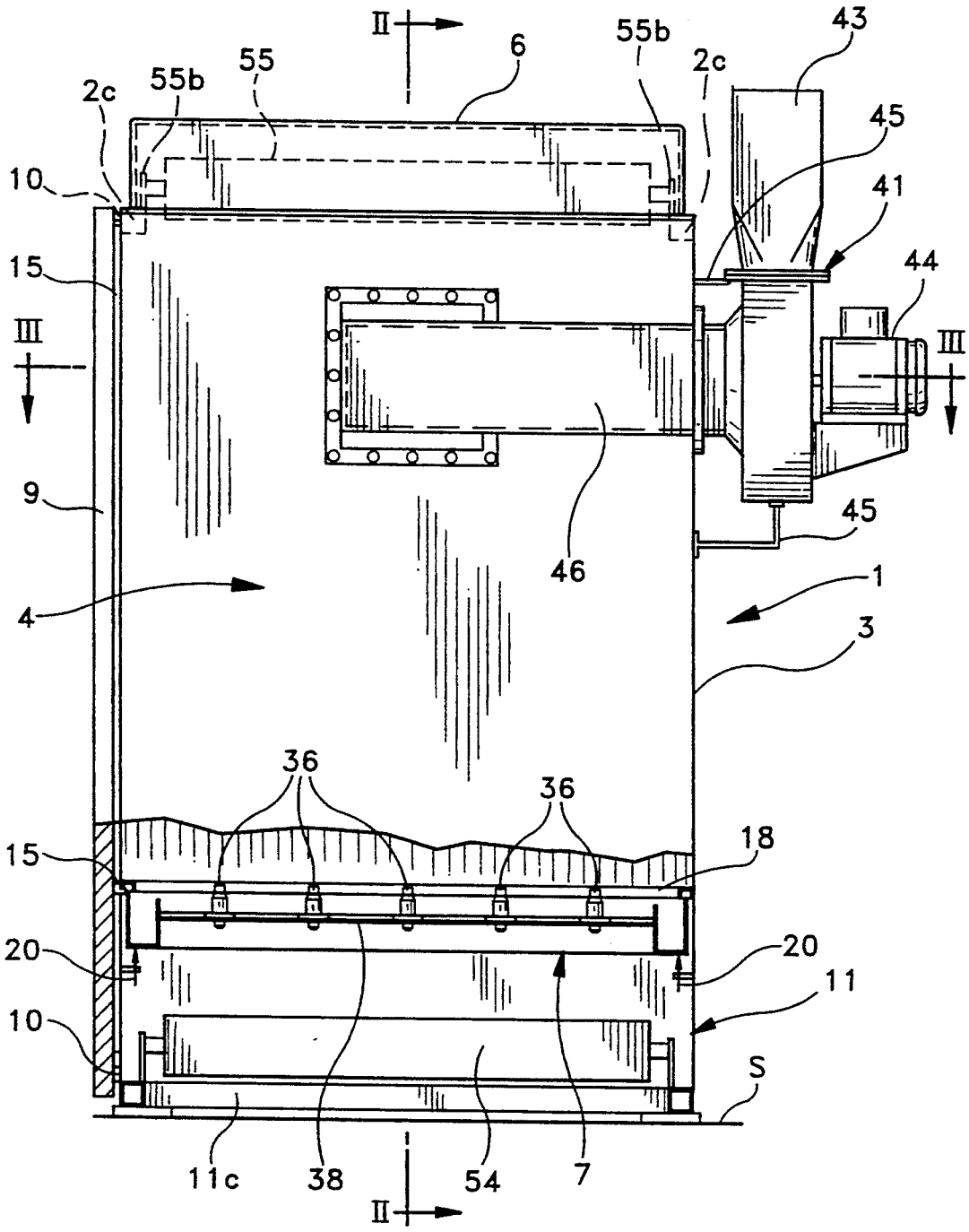
FIG. 1 is a partially cut away side view of said remoistening apparatus.
Figure 2:
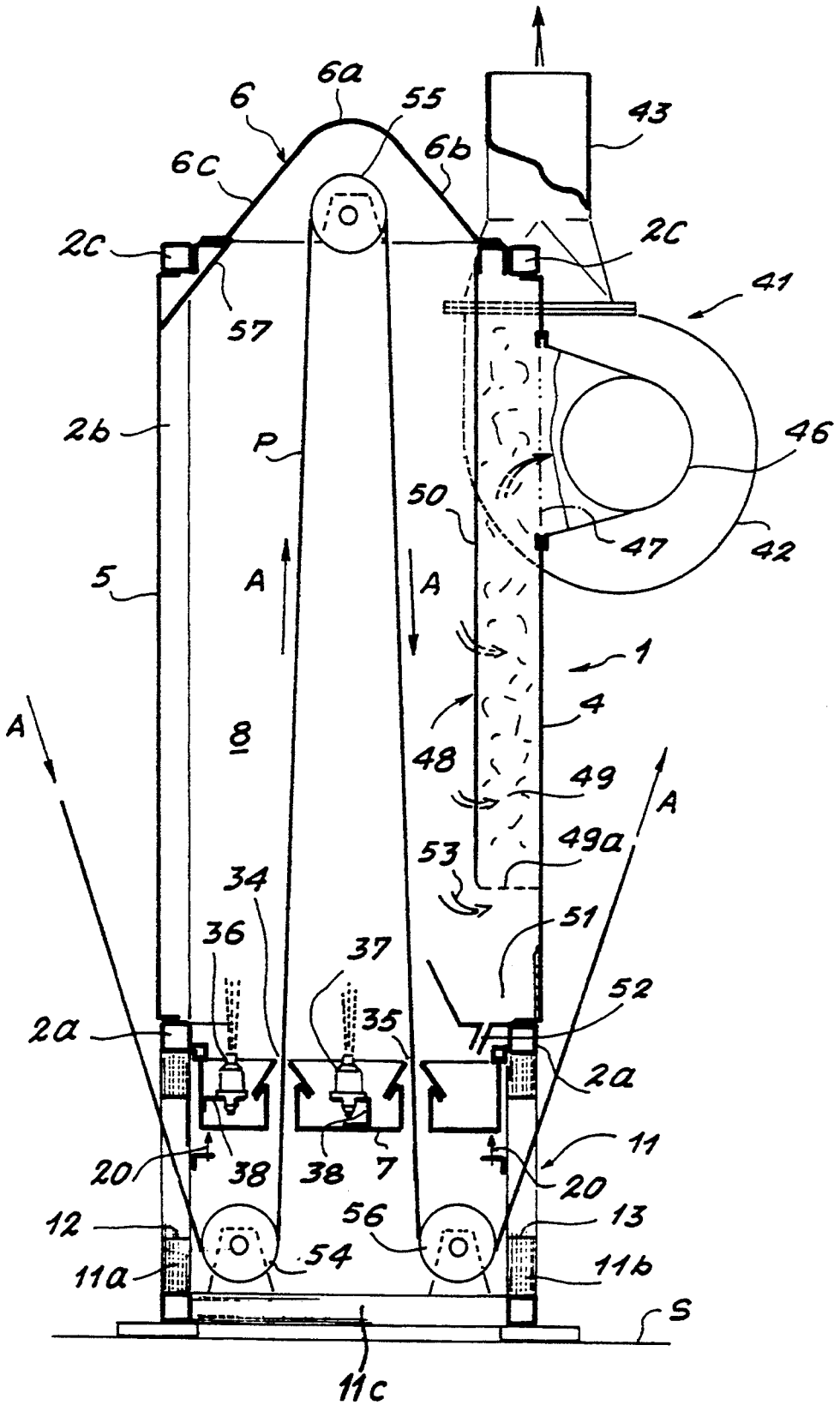
FIG. 2 is a sectional view of the same taken along line II—II of FIG. 1.

The remoistening apparatus illustrated by FIGS. 1 to 3 is externally in the shape of a cabinet 1 constructed from metal beams, such as *2a*, *2b*, *2c*, which are joined together in the form of a parallelepiped-like framework having a height and depth larger that its width. Metal sheets integrally secured to beams *2a* to *2c* provide the rear wall 3, side walls 4, 5 and roof 6 of the cabinet 1 which together with a floor 7 made in the form of a rectangular pan limit an enclosure 8 closed in its front part by a pivoting door 9 fitted with vertical hinges 10.

The so constructed cabinet 1 is integral with a hollow pedestal 11, by which it rests on the ground S, and door 9 is extended downwardly to close the front part of said pedestal 11 further having each of its side walls 11*a*, 11*b* pierced with a respective window 12 or 13, the use of which will be discussed below.

According to the invention, the enclosure 8 is sealed. To this effect, the integral securing of sheets 3, 4, 5 and 6 to the beams 2 as well as the joining together of said beams are performed by means of continuous weld seams, possibly coupled with seals. For the same purpose, door 9 is internally fitted with a rubber sealing pad 15, which upon closure of the door is pressed between the latter and the periphery of the front opening of cabinet 1; finally, the vertical walls, such as 16, of the pan 7 forming the floor of the enclosure 8 are attached by their upper end, such as by means of bolts, in a continuous sealing packing 17 retained in U-shaped profiles 18, which, in turn, are welded to the beams 2*a* limiting the base of the enclosure 8, as can be best seen in the detail view of FIG. 4.

Said figure additionnally shows in conjunction with FIG. 1 that the pan 7 is bearing by its bottom 19 on large-sized screws 20 carried in two rows by angle brackets 21 welded on the inside of the side walls 11*a*, 11*b* of the pedestal 11 of cabinet 1, these supporting screws reinforcing the mounting of the pan.

It may also be seen in the same figures that two passageways 22 providing communication between the internal space of the pedestal 11 and the enclosure 8 are formed in the bottom of the pan 7. Each of said passageways 22 is limited, from an opening 23 in the bottom 19 of the pan, by two vertical wall sections 24, 25 integrally formed with said bottom 19 and generally parallel with the side walls 4, 5 of the cabinet, each having on the upper end thereof a lip 26, 27, which is turned back downwardly and outwardly of the passageway 22. The two lips 26, 27 of wall sections 24, 25 support respectively two rectangular shutters 28, 29 pivoted about axes 30, 31 generally parallel with said wall sections. Spiral springs not shown urge both shutters 28, 29 against respective pins, such as 32 and 33, protruding into the pan 7 from two vertical walls facing the latter which close the two passageways 22 at the ends thereof. It should be further noted that the wall sections 24, 25 limiting the two passageways 22, as well as the shutters 28, 29 supported thereon, apply against the above-mentioned vertical walls of the pan 7 through sealing packings not shown. Turning back to FIGS. 1 and 4, it will be noted additionally that, on each of said walls, the pins 32, 33 are so positioned as to maintain both shutters 28, 29 converging upwardly. Thus, the shutters 28, 29 in each pair delimit beyond their supporting pins 32, 33 a narrow slot 34 or 35 spanning the full length of the pan 7 in the direction of the depth of cabinet 1.

Referring to FIGS. 1 to 3 simultaneously, it may further be seen that two parallel rows of five spray nozzles 36 and 37 are installed within the pan 7, on each side of slot 34, which is the closest when opening the door 9 of cabinet 1 (FIG. 2). Nozzles 36 or 37, which are uniformly spaced in each row, are supported by means of fastening brackets, such as 38, by a vertical side wall 16 and the bottom 19 of pan 7, respectively. Furthermore, they are directed to the inside of the enclosure 8, in a generally vertical orientation. Ducts, such as the one designated by reference numeral 39 in FIG. 4, connect each of said nozzles 36, 37 to a water loaded compressed air source not shown, which may be housed within the pedestal 11 of the cabinet 1, each duct 39 passing through the bottom 19 of the pan 7 via a sealing ring 40.

According to the invention, the remoistening apparatus examplified in FIGS. 1 to 3 is equipped with a fan, here a centrifugal fan of a conventional type shown under reference 41 with its volute 42, vertical discharge funnel 43 and motor 44. The discharge funnel 43 may be connected to a paper storage shop for ensuring uniform moistening thereof. As shown in FIG. 3, the fan 41 is supported in its top part and externally of the cabinet 1 by lugs 45 fastened to the vertical beam 2*b* forming the righthand rear corner of said cabinet. The axial suction duct 46 of the fan 41 extends horizontally along the right side wall 4 of cabinet 1 and connects, via a bend 46*a* and through a grating protected opening 47 provided in the middle of said wall 4, to a droplet separator 48 extending along the latter, within the enclosure 8.

As can be seen from FIGS. 2 and 3, the droplet separator 48 is made of a three-dimensional mesh 49 of closely entangled metal fibres, held over the full width of the enclosure side wall 4, within and over the entire crosssection of a duct formed between said wall 4 and a partition 50 integrally secured to the vertical beams 2*b* supporting it. The fibre mesh 49 which extends from the top of wall 4, bears on a netting 49*a* stretched between the latter and the partition 50, above and away from a tank 51 opening in 52 into the pan 7 forming the floor of the enclosure 8. At its base, partition 50 defines a wide opening 53 providing communication between the enclosure 8 and the droplet separator and, through the latter and the grating protected opening 47, the suction duct 46 of the fan 41.

The partition 50 also defines along its vertical side walls 53', 53" side openings located between the netting 49*a* and the upper beams 2*c* which provide communication between the enclosure 8 and the duct 46 through a part of the droplet separator 48.

The remoistening apparatus just described is intended to be incorporated at the outlet of a drier into a paper printing line, such as a rotary press line for the production of newspapers or other printed publications. The continuous web of printed paper P exiting from the drier and running at a uniform speed under the action of conventional drive means not shown, passes into and out of the remoistening apparatus through the left 12 and right 13 side windows of its pedestal 11, respectively. Within the remoistening apparatus, the web P enters the enclosure 8 through the lefthand slot 34 of the enclosure floor which is bordered with nozzles 36, 37, and exists therefrom through the righthand slot 35 following a path defined by three idle rollers 54, 55, 56.

Said idle rollers 54, 55, 56 have axes generally parallel with the slots 34, 35 and are, as are the latter, of a length slightly exceeding the width of the standard paper webs used for printing on rotary press machines. Two of them 54, 56 are mounted within the pedestal 11 and on the base 11*c* thereof, the first one between the left side wall 11*a* of the pedestal and the vertical plane of the first slot 34 of pan 7, and the second one 56 between the vertical plane of the second slot 35 of said pan and the right side wall 11*b* of the pedestal 11 of cabinet 1. The third roller 55 is supported in 55*a* and 55*b* (FIG. 1) by two upper horizontal beams 2*c* of the framework of cabinet 1, in the top part of enclosure 8, under the roof 6 thereof which assumes the form of a vault triangular in cross-section having its rounded apex 6*a* oriented in the same direction as the roller 55. As may be seen in FIG. 2, the right side 6*b* of the vault-shaped roof 6 of the enclosure 8 connects in a continuous manner to the partition 50 of the latter, and its left side 6*c* extends through a deflector plate 57 of same inclination which joins the left side wall 5 of the enclosure 8. It should be further specified that roller 55 is positioned between the two above-mentioned vertical planes of the inlet and outlet slots 34, 35 of paper web P.

Before initiating the printing process itself, the operator, after opening the door 9 of the remoistening apparatus which provides access to both the enclosure 8 and the interior of the pedestal 11, can readily place the web of paper P exiting from the drier, along its running path within the enclosure 8 (as indicated by arrows A in FIG. 2), by passing it successively through the left side window 12 of the pedestal 11, under the roller 54, through the inlet slot 34 into the enclosure, over the roller 55, then through the outlet slot 35, under the roller 56 and through the right window of pedestal 11, wherefrom the web P will be introduced into the next functional unit of the printing line. For the manual execution of this preliminary operation, the web of paper will be fed at low speed or by fits and starts by the driving means integrated in the printing line. The operator may additionally move temporarily aside the two pivoting shutters 28, 29 defining each of the slots 34 and 35, so as to pass the web of paper P more easily into and out of the enclosure 8.

Next, the continuous printing process can be initiated from a centralized control console not shown, and as soon as the first printed section of the web of paper exists from the drier, the operator starts the remoistening apparatus. Each of the nozzles 36 and 37 then sprays a diverging stream of fine water droptlets suspended in pressurized air into the enclosure 8, as shown in dashed lines in FIG. 2. The gathering of such streams released on either side of the web inlet slot 34 generates on each side of the rising course of said web a moistening mist impregnating efficiently from its two sides the web of printed paper which is thus remoistened.

At the same time, the fan 41 will create sufficient underpressure within the enclosure 8 to circulate the mist, especially in the channel defined, on one side, by the web P, and on the other side, by the left side wall 5, the vault-shaped roof 6 and the partition 50 of the enclosure, the mist being then drawn through the wide lower opening 53 and the side openings 53', 53'' of the droplet separator and driven through the latter to be ejected outside of the remoistening apparatus through the fan discharge funnel 43.

The thus generated circulation of the mist within the enclosure 8 equalizes advantageously the remoistening of the web of paper P over the full width thereof, but more importantly, its discharge out of the enclosure which is then ensured by the fan 41 reduces the mist holding time within the enclosure to the minimum required for this remoistening operation. Coupling the above with the fact that the channel through which the mist circulates is free of any dead space, especially due to the presence of the deflector plate 57 and to the vault-shape of the roof 6 of the enclosure 8, results appreciably in reducing to a large extent the formation of water drops on all the walls limiting the enclosure. The possibly formed water drops may additionally drip down both the inclined sides **6*b*, 6*c* of the roof and the vertical walls 5 and partition 50 of the enclosure 8 and be collected in the pan 7** without contacting at any time the running web of printed paper, which thus leaves the remoistening apparatus in a clean and smooth condition.

Besides, the droplet separator 48, which is positioned upstream of the fan 41 intercepts the water droplets in the remoistening mist prior to the ejection of the latter into the closed premises in which the printing line is installed or into a paper storage shop, which advantageously results in keeping the ambient degree of moisture to a level acceptable for the service personnel or stored paper. Indeed, it is important not to water saturate the working premises, and it may be very useful to keep the stored paper at a high degree of moisture before printing. The thus captured water then drips in tank 51 and is also collected in pan 7, which can be emptied regularly by means of a drain pipe with stop valve, not shown.

It goes without saying that the flow rate of the nozzles 36, 37 for spraying the mist and of the fan 41 for drawing said mist out of the enclosure must be set according to various parameters, such as the nature of the paper to be remoistened, its basis weight, its running speed within the enclosure, etc.

In this respect, it has been found that for the spraying rates and pressures of the nozzles 36, 37, as currently used, the produced streams of compressed air loaded with water droplets are alone enough to achieve in the vicinity of slots 34, 35 the sealing required for the good progress of the above described remoistening process. However, to guarantee the achievement of said sealing in all cases, the remoistening apparatus according to the invention is provided within the enclosure 8 and on either side of each said slot 34, 35 with respective dry air blowing ramps, as shown in 58 and 59 in FIG. 4 with respect to the inlet slot 34 of the web P. The ramps 58, 59 made of tubes 60, 61, each provided with nozzles 62, 63, are fastened by supports, such as 64, on the turned back upper lips of the wall sections of pan 7 and are directed parallel to the slots which they are bordering. The nozzles 62, 63 of the two combined ramps associated with each slot 34, 35, are additionally converging upwardly flush with the web of paper P. Each of the tubes 60, 61 further connects via a conduct not shown seaiingly passing through the bottom of the pan 7 to a compressed air source housed in the pedestal 11.

Thus, when needed, the ramps 58, 59 may be started so that the pressurized dry air streams produced by their nozzles 62, 63 disposed in closely spaced rows, form air waves directed to both faces of the web along each slot 34, 35 in the floor 7 of the enclosure 8, and in this manner achieve the sealing desired at each said slot, without changing the degree of moisture within the enclosure 8.

I claim:

1. A paper remoistening apparatus of the type comprising means (54, 55, 56) for driving a strip of paper (P) along a predetermined path within a sealed enclosure (8), into which nozzles (36, 37) for spraying a moistening mist open, said enclosure (8) communicating at a place remote from the spray nozzles (36, 37) with the inlet of a suction device (41) having its outlet (43) opening outside the enclosure, characterized in that the inlet of the suction device (41) communicates with the enclosure (8) through a droplet separator (48).

2. The remoistening apparatus according to claim 1, characterized in that the suction device comprises a fan (41).

3. The remoistening apparatus according to claim 1 or 2, characterized in that the droplet separator (48) comprises a duct (4, 50) fitted internally and over its entire cross-section with a three-dimensional mesh (49) of entangled metal fibres, said duct being, on one side, connected to the inlet of the suction device and opening, on the other side, into the bottom portion of the enclosure (8), away from the path of the strip of paper (P) and above a tank (51).

4. The remoistening apparatus according to claim 3, characterized in that the duct (4, 50) further comprises side openings (53', 53'') in a region located between the bottom portion of the enclosure (8) and the suction device (41).

5. The remoistening apparatus according to claim 3, characterized in that the enclosure (8) is limited in its bottom portion by a floor (7) provided with two generally parallel narrow slots (34, 35) for the strip of paper (P) to come in and out, respectively, and the spray nozzles (36, 37) are disposed in two rows extending on each side of one same slot (34), with the inlet of the suction device (41) communicating with the bottom portion of the enclosure on the side of the second slot (35) opposite to the first slot.

6. The remoistening apparatus according to claim 5, characterized in that the two rows of nozzles (36, 37) extend on each side of the inlet slot (34) of the strip of paper.

7. The remoistening apparatus according to claim 5 characterized in that the bottom opening (53), through which said inlet of the suction device (41) communicates with the enclosure (8) extends in the same direction and at least over the same length as the rows of nozzles (36, 37).

8. The remoistening apparatus according to claim 3, characterized in that the enclosure (8) has a vault-shaped roof (6) connecting without any dead space to the adjacent walls (5, 50) of the enclosure.

9. The remoistening apparatus according to claim 3, characterized in that the enclosure (8) has a pan-shaped floor (7).

10. The remoistening apparatus according to claim 3, having its enclosure (8) limited in the bottom part thereof by a floor (7) provided with two slots for the strip of paper (P) to come in and out, respectively, characterized in that each of said slots (34, 35) is bordered on its two sides by two respective dry air blowing ramps (58, 59).

* * * * *